United States Patent [19]

Plyler et al.

[11] Patent Number: 4,687,270

[45] Date of Patent: Aug. 18, 1987

[54] FUSE PACKAGE

[75] Inventors: Robert G. Plyler, Vienna; Jay H. Garretson, Warren, both of Ohio

[73] Assignee: General Motors Corporation, Detroit, Mich.

[21] Appl. No.: 886,646

[22] Filed: Jul. 18, 1986

[51] Int. Cl.[4] ..... H01R 13/68; H01R 13/627

[52] U.S. Cl. ..... 439/350; 361/430; 439/621

[58] Field of Search ..... 339/217 R, 217 TP, 147 R, 339/147 P, 91 R, 198 J; 361/430, 431, 432

[56] References Cited

U.S. PATENT DOCUMENTS

| | | | |
|---|---|---|---|
| 3,699,500 | 10/1972 | Borzoni et al. | 339/91 R |
| 4,148,538 | 4/1979 | Rodondi | 339/91 R |
| 4,531,797 | 7/1985 | Jullien et al. | 339/198 J |
| 4,602,839 | 7/1986 | Winger | 339/217 R |

*Primary Examiner*—Gil Weidenfeld
*Assistant Examiner*—Gary F. Paumen
*Attorney, Agent, or Firm*—Patrick M. Griffin

[57] ABSTRACT

A fuse package for a vehicle handles a row of plug-in type fuses in a simple and convenient fashion. An insulator block includes a plurality of terminals arrayed so that a row of fuses held in a cover will plug into the terminals as the cover is installed on the block. The terminals grip the fuses more strongly than the fuses are held within the cover so that the terminals will be pulled out of the cover and stay plugged in to the terminals as the cover is removed, giving easy servicing access to the fuses. The fuses are not held within the cover strongly enough to stay with the cover as the cover is handled, however. A retainer fits within the cover strongly enough to maintain the cover and fuses as a unitary assembly that can be separately handled and installed. The retainer also includes a locking means that interengages with a locking means on the block as the cover assembly is installed to cooperatively keep the cover on the block. The locking force is also strong enough to pull the retainer out of the cover as the cover is removed. The retainer therefore stays with the block so as to let the fuses by easily accessed.

3 Claims, 6 Drawing Figures

FUSE PACKAGE

This invention relates to fuse assemblies in general and specifically to a fuse package for retaining and handling a row of plug-in type fuses.

BACKGROUND OF THE INVENTION

An automotive fuse finding increasing use is a plug-in fuse of the type described in the U.S. Pat. No. 3,909,767. Such a fuse has a plastic body which includes an internal fusible link and a pair of parallel spaced blade contacts that extend out of the body. As befits the name, such a fuse is joined to the electrical system by plugging its blade contacts into suitable terminals that are otherwise connected to the vehicle's electrical system. Its plastic body provides a convenient handle for plugging the fuse in and pulling it out for servicing. The U.S. patents disclose several fuse assemblies specifically adapted to incorporate a fuse of this type. The U.S. Pat. No. 4,560,227 shows an individual panel mounted holder for such a fuse, several of which may be mounted to a panel in an array. The U.S. Pat. Nos. 4,221,455; 4,221,456; 4,226,493; and 4,238,140 all relate to a terminal block for the same type of fuse. The structure disclosed in those patents is somewhat complex, including a large terminal block with an array of passages therein that receive various structural subunits, such as fuse holders, connector adaptors and accessory connectors. The subject invention also is adapted to incorporate fuses of the same type, but provides features not found in the patents just discussed.

SUMMARY OF THE INVENTION

The invention provides a convenient package for a row of plug-in fuses, giving simplified handling and installation as well as replacement and servicing of the fuses. The preferred embodiment of the package includes an insulator block with a pair of parallel rows of terminals that are adapted to receive the blade contacts of the row of fuses as they are plugged in. The terminals hold the fuse contacts with a gripping force sufficient to keep the fuses in place until they are purposely pulled out. The insulator block also includes a first locking means in the form of a pair of spaced ramps which are located between the rows of terminals.

The preferred embodiment also includes a cover adapted to be installed on and removed from the insulator block. The cover is also adapted to hold a row of fuses with a holding force sufficient to maintain the fuses in the proper orientation to plug into the terminals as the cover is installed. However, that holding force is less than the terminal gripping force so that the fuses are pulled out of the cover and remain plugged into the terminals as the cover is removed. In the preferred embodiment, the cover is generally in the form of an open box with a pair of spaced end walls which cooperate with other structure to be described below.

The package also includes a fuse retainer which is sufficiently long for its ends to be biased between the spaced end walls of the cover and between the blades of the row of fuses. The retainer fits within the cover with a retention force that is sufficient to prevent the fuses from falling out of the cover before installation. The fuses, retainer and the cover may, therefore, be handled and installed together as a unitary assembly. This provides a very convenient means of handling and shipping the fuses. It also provides a convenient means for plugging the fuses into the block terminals all at once, since the fuses are already properly oriented and held within the cover. The retainer also includes a second locking means, which is interengageable with the first locking means on the insulator block. In the preferred embodiment, this second locking means includes a pair of flexible legs that extend out from the retainer, located inboard of the ends of the retainer. These flexible legs are spaced apart a distance substantially equal to the spacing of the ramps on the insulator block.

As the unitary cover-retainer-fuses assembly is installed on the block, the flexible retainer legs concurrently flex past and interengage with the spaced ramps on the insulator block, but without disturbing the bias of the retainer ends between the cover walls. This interengagement provides a locking force which is sufficient to lock the retainer to the block. The net effect is that the cover is retained to the block, since the retainer is fitted between the end walls of the cover with the retention force described above. The locking force provided by the flexible leg-spaced ramp interengagement is greater than the retention force, however. Therefore, the ends of the retainer are pulled from between the spaced end walls of the cover, and the retainer stays with the block. Thus, the retainer does not act to keep the fuses within the cover as the cover is removed, and the fuses conveniently remain with the block for easy individual access and removal. The cover may then be reinstalled, and will be retained to the block as before.

It is, therefore, an object of the invention to provide a package that easily handles and retains a plug-in fuse by holding the fuse within a cover in the proper orientation to plug into terminals of an insulator block as the cover is installed on the block, but with less holding force than the gripping force of the terminals, so that the fuse remains plugged into the terminals as the cover is removed from the insulator block for easy access to the fuse.

It is another object of the invention to provide a package of the type described for a plug-in fuse with a body and a pair of parallel blades in which the insulator block also has a first locking means located between the terminals, and in which a fuse retainer is sized so as to be fitted within the cover between the fuse blades with a retention force sufficient to prevent the fuse from falling out of the cover before installation, so that the fuse, retainer and cover may be handled and installed together as a unitary assembly, and in which a second locking means is located on the retainer so as to interengage with the first locking means on the insulator block as the unitary assembly is installed with a locking force sufficient to lock the retainer to the block and thereby retain the cover to the block, with the locking force being greater than the retention force so that the retainer will stay with the insulator block and between the fuse blades as the cover is removed.

It is yet another object of the invention to provide such a fuse package for retaining and handling a row of plug-in fuses of the type described in which the insulator block has two parallel rows of electrical terminals adapted to receive the blades of the row of fuses and also has a pair of spaced ramps located between the rows of terminals, and in which the cover has a pair of spaced walls and a fuse retainer is sufficiently long for its ends to be biased between the cover walls and between the fuse blades with a retention force sufficient to prevent the fuses from falling out of the cover before installation, and in which the retainer also has a pair of flexible legs extending out therefrom inboard of the retainer ends and spaced apart a distance substantially equal to the spaced ramps on the insulator block, so that, as the unitary cover assembly is installed, the flexible legs interengage with the spaced ramps with a locking force sufficient to lock the retainer to the block and thereby retain the cover to the block.

DESCRIPTION OF THE PREFERRED EMBODIMENT

These and other objects and features of the invention will appear from the following written description and the drawings, in which.

Figure 1:
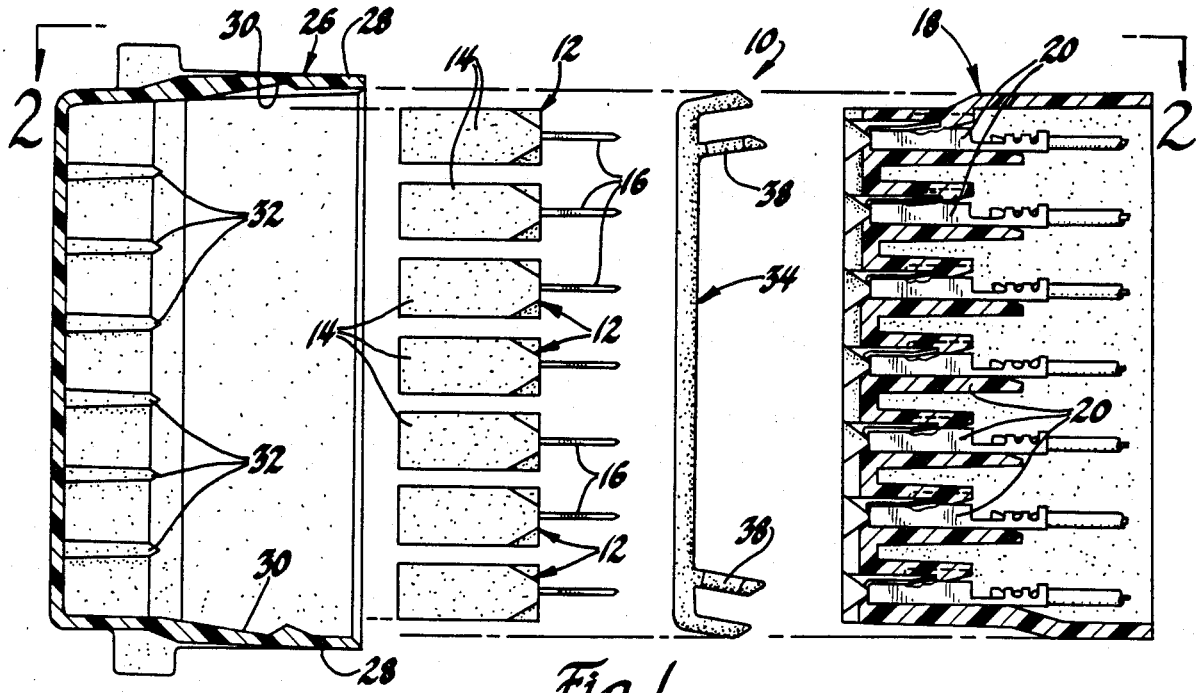
FIG. 1 is an exploded plan view of the preferred embodiment of the invention, showing the cover and insulator block in cross section.
Figure 2:
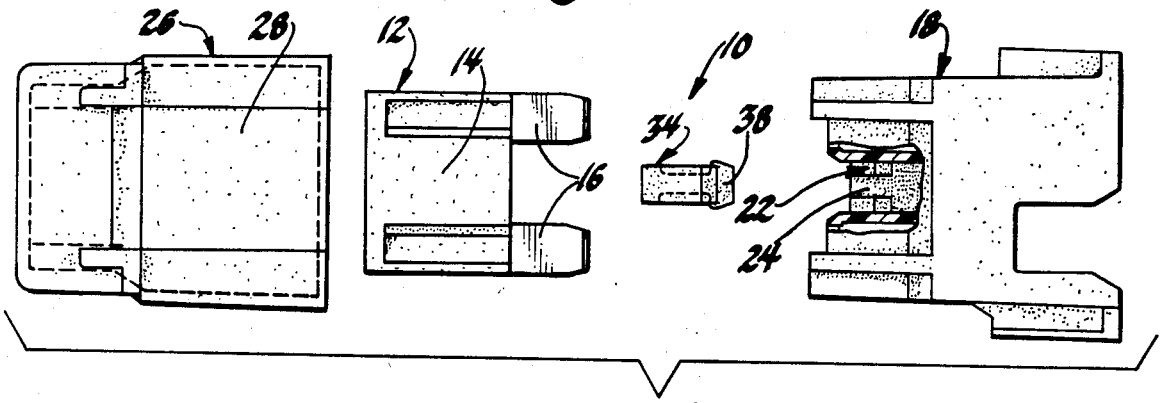
FIG. 2 is an exploded side view of the preferred embodiment.

Referring first to FIGS. 1 and 2, the preferred embodiment of the invention is designated generally at 10. The invention provides a convenient package that easily handles and retains a fuse of the plug-in type designated generally at 12, specifically a row of seven such fuses 12. Each fuse 12 includes a plastic body 14 within which a fusible link is contained and a pair of parallel blade contacts 16 extending therefrom. Therefore, the row of seven fuses 12 present two parallel rows of blade contacts 16. An advantage of a fuse 12 of the plug-in type is that its relatively large plastic body 14 provides a convenient grip for insertion and removal of the fuse into and out of the vehicle's electrical system. The invention 10 advantageously handles the entire row of fuses 12, as well as providing for easy replacement and servicing of the individual fuses 12, as will appear below.

Figure 5:
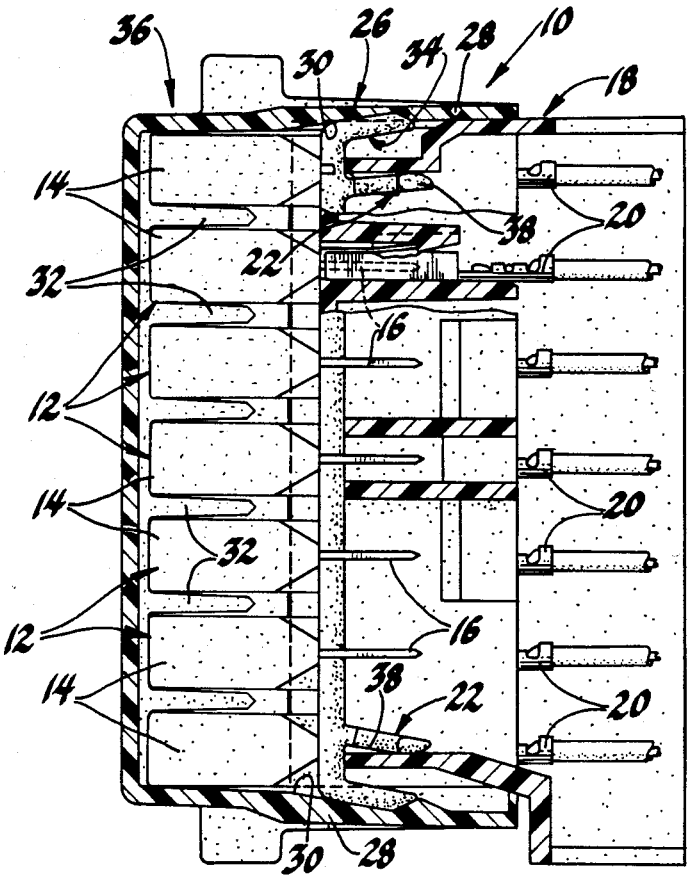
FIG. 5 is a view similar to FIG. 1, but with all the parts assembled.
Figure 6:
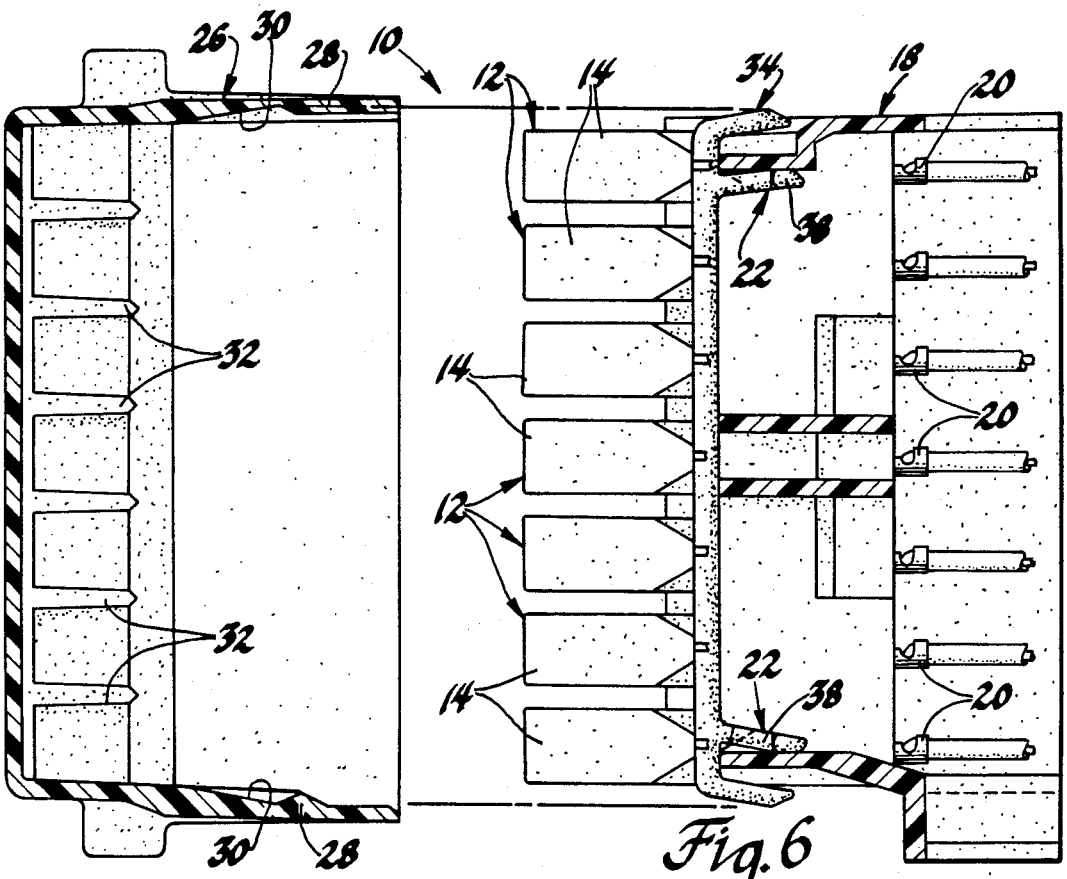
FIG. 6 is a view similar to FIG. 5, but with the cover removed.

Referring now to FIGS. 1, 5 and 6, a plastic insulator block generally in the shape of a box is designated at 18. Insulator block 18 includes a pair of parallel rows of terminals 20 arrayed therewithin, one pair of terminals 20 respective to each fuse 12. The terminals 20 are otherwise connected to the vehicle electrical system, not illustrated, in conventional fashion. The terminals 20 are designed to be sufficiently resilient to grip and hold the blade contacts 16 of the row of fuses 12 as they are plugged in, as best seen in FIG. 5. The gripping force of the terminals 20 on the fuse contacts 16 is sufficient to keep the fuses 12 in place on the block 18, as seen in FIG. 6, until they are purposely pulled out.

Figure 4:
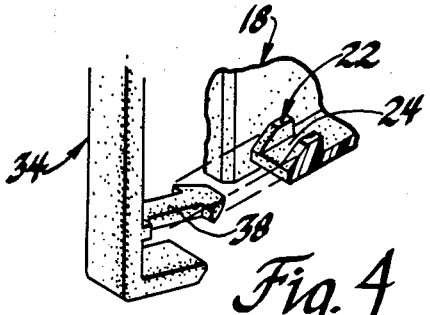
FIG. 4 is an isometric view of one end of the retainer and that portion of the insulator block with which it interengages.

Referring now to FIGS. 1, 2 and 4, the insulator block 18 also includes a pair of integrally molded ramps designated generally at 22, which are spaced apart by a distance described below. As best seen in FIG. 2, which has part of the block 18 broken away to illustrate the most distant ramp 22, the ramps 22 are located between the rows of terminals 20. As seen in FIG. 4, the ramps 22 slope inwardly and toward one another, and each ramp 22 also includes a central slot 24. The spaced ramps 22 comprise a first locking means, as will be later explained.

Figure 3:
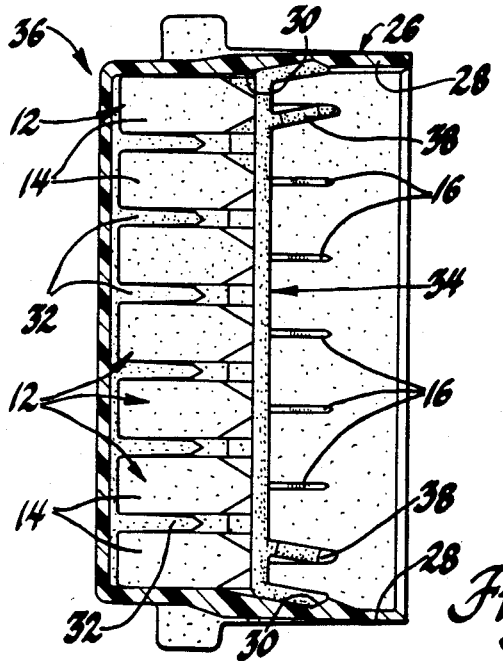
FIG. 3 is a plan view showing just the unitary assembly of the cover, retainer, and fuses, with the cover in cross section.

Referring now to FIGS. 3, 5 and 6, the invention 10 also includes a plastic cover, designated generally at 26, molded in the form of an open box with a pair of spaced end walls 28. The inside of each end wall 28 also includes a shallow, sloped groove 30 for a purpose described below. Cover 26 is sized so as to fit over block 18, and can therefore be installed on and removed therefrom with a simple push fit. The installed position is shown in FIG. 5, and the removed position in FIG. 6. The bottom of cover 26 is provided with a row of six internal dividers 32 which are spaced sufficiently closely to hold the row of seven fuses 12 with a holding force sufficient to maintain them in the proper orientation to plug into the terminals 20 all at once as the cover 26 is installed. However, the dividers 32 are spaced apart sufficiently that the holding force is less than the gripping force of the terminals 20. Consequently, the fuses 12 remain plugged into the terminals 20 and stay with the insulator block 18 as the cover 26 is removed, see FIG. 6, where they may be easily accessed for individual removal and replacement. In fact, in the preferred embodiment, the holding force of the cover 26 is very slight, and the fuses 12 may be very easily dropped into the cover 26 with no binding. This is desirable for ease of assembly, but it also means that the fuses 12 would fall out of the cover 26 without additional structure, and the advantage of having the fuses 12 oriented so as to plug into the terminals 20 all at once as the cover 26 is installed would be largely illusory. Additional structure, described next, solves that problem, as well as providing other advantages.

Referring next to FIGS. 1, 3, and 5, a fuse retainer designated generally at 34 and molded of resilient plastic is sufficiently long for its ends to be biased between the cover's spaced end walls 28. In the preferred embodiment, the ends of the retainer 34 resiliently snap into the shallow grooves 30 of the cover end walls 28, as best seen in FIG. 3. The retainer 34 is added after the fuses 12 have been dropped into the cover 26, and it fits between the blades 16 of the row of fuses 12, against or near the fuse bodies 14. The retainer 34 is biased between the cover end walls 28 with a retention force that is sufficient to prevent the fuses 12 from falling out of the cover 26, even if it is turned upside down and shaken moderately, as can be expected during normal shipping and handling. The fuses 12, retainer 34 and cover 26, therefore, make up an easily handled unitary assembly, designated generally at 36 in FIG. 3. Furthermore, the retainer 34, located as it is between the rows of fuse blade contacts 16, will not interfere with the plugging in of the fuses 12. Therefore, the unitary assembly 36 may be installed as would just the cover 26 and fuses 12 together, with the fuses 12 all plugging in to the terminals 20 at once, as seen in FIG. 5.

Referring now to FIGS. 4, and 5, retainer 34 also includes a pair of generally T-shaped flexible legs 38 that extend out from the retainer 34, located inboard of the ends of the retainer 34. These flexible legs 38 are spaced apart a distance substantially equal to the spacing of the insulator block ramps 22, and comprise a second locking means, which is interengageable with the first locking means on the insulator block 18. It will be recalled that the spaced ramps 22 are located between the terminals 20, and that the retainer 34 is located between the fuse contacts 16, which plug into the terminals 20. It will be understood, therefore, that as the unitary cover assembly 36 is installed on the block 18, the flexible legs 38, spaced apart and located as they are, will concurrently slide over the insulator block spaced ramps 22 and flex toward one another. The flexible legs 38 are sufficiently inboard of the ends of the retainer 34 so as not to pull them out of the cover grooves 30 while flexing. As the legs 38 slide beyond the spaced ramps 22, they snap down into the slots 24, giving a strong interengagement at the installed position of FIG. 5. This interengagement provides a locking force which is sufficient to lock the retainer 34 to the block 18. Recalling that the retainer is already biased inside the cover 26 with the retention force described above, the net effect is that the cover 26 is retained to the block 18. Thus, the retainer 34 does more than provide the unitary assembly 36, and no separate structure is necessary to lock the installed cover 26 to the block 18.

Referring next to FIG. 6, the locking force provided by the flexible leg 38-spaced ramp 22 interengagement is significantly greater than the retention force of the retainer 34—grooves 30. Therefore, the ends of the retainer 34 are pulled out of the cover grooves 30 as the cover 26 is removed. Since the retainer 34 stays with the insulator block 18, the fuses 12 will not be kept in the cover 26 as it is removed. Instead, the fuses 12 remain plugged into the terminals 20, easily accessible and visible for individual removal and replacement. The ends of the retainer 34 will snap back into the cover grooves 30 to again lock the cover 26 to the block 18 when the cover 26 is reinstalled. Furthermore, because of the spatial relation of the legs 38 to the ends of the retainer 34, when the cover 26 has been removed, the ends of the retainer 34 can be pinched inwardly, which will bow the retainer 34 out and cause the flexible legs 38 to move out of the ramp slots 24. Then, the retainer 34 can be easily pulled off of the block 18 and again added to the cover 26 to reconstitute the unitary assembly 36.

Many variations of the preferred embodiment are possible within the spirit of the invention. Plug-in fuses of a type other than that disclosed may be used, although the retainer 34 works particularly well with the row of fuses 12 and the parallel row of blade contacts 16. The invention could be constructed to handle a single fuse, although it is obviously desirable to handle a plurality in most applications. Some other means could be used to keep the retainer 34 within the cover 26, although the shallow grooves 30 are easy to mold and cooperate simply with the ends of the retainer 34. The cooperating first and second locking means could comprise other structure configured to interengage as the cover assembly 36 is installed. Therefore, it will be understood that it is not intended that the invention be limited to the single embodiment disclosed.

The embodiments of the invention in which an exclusive property or privilege is claimed are defined as follows:

1. A fuse package for retaining and handling a plug-in type fuse, said package comprising, an insulator block including a first locking means and an electrical terminal adapted to receive said plug-in fuse with a gripping force, a cover adapted to be installed on and removed from said insulator block and also adapted to hold a plug-in type fuse with a holding force sufficient to maintain said fuse in the proper orientation to plug into said terminal as said cover is installed, but less than said gripping force so that said fuse remains with said terminal and block as said cover is removed, a fuse retainer sized so as to be fitted within said cover with a retention force sufficient to prevent said fuse from falling out of said cover before installation, so that said fuse, retainer and cover may be handled and installed together as a unitary assembly, and a second locking means on said retainer interengageable with said first locking means on said insulator block as said unitary assembly is installed with a locking force sufficient to lock said retainer to said block and thereby retain said cover to said block, said locking force being greater than said retention force whereby said retainer stays with said insulator block as said cover is removed, thereby allowing said fuse to remain with said block and be easily removed and replaced prior to reinstalling said cover.

2. A fuse package for retaining and handling a plug-in fuse of the type having a fuse body and a pair of parallel blades, said package comprising, an insulator block including electrical terminals adapted to receive said fuse blades with a gripping force and a first locking means located between said terminals, a cover adapted to be installed on and removed from said insulator block and also adapted to hold a plug-in fuse of said type with a holding force sufficient to maintain said fuse in the proper orientation to plug into said terminals as said cover is installed, but less than said gripping force so that said fuse remains with said terminals and block as said cover is removed, a fuse retainer sized so as to be fitted within said cover between said fuse blades with a retention force sufficient to prevent said fuse from falling out of said cover before installation so that said fuse, retainer and cover may be handled and installed together as a unitary assembly, and a second locking means located on said retainer so as to interengage with said first locking means on said insulator block as said unitary assembly is installed with a locking force sufficient to lock said retainer to said block and thereby retain said cover to said block, said locking force being greater than said retention force whereby said retainer stays with said insulator block and between said fuse blades as said cover is removed, thereby allowing said fuse to remain with said block and be easily removed and replaced prior to reinstalling said cover.

3. A fuse package for retaining and handling a row of plug-in fuse of the type having a fuse body and a pair of parallel blades, said package comprising, an insulator block including two parallel rows of electrical terminals adapted to receive said fuse blades with a gripping force and also including a pair of spaced ramps located between said rows of terminals, a cover having a pair of spaced walls and adapted to be installed on and removed from said insulator block and also adapted to hold a row of said plug-in fuses of said type with a holding force sufficient to maintain said fuses in the proper orientation to plug into said terminals as said cover is installed, but less than said gripping force so that said fuses remain with said terminals and block as said cover is removed, a fuse retainer sufficiently long for the ends thereof to be biased between said cover walls and between said fuse blades with a retention force sufficient to prevent said fuses from falling out of said cover before installation so that said fuses, retainer and cover may be handled and installed together as a unitary assembly, and a pair of flexible legs extending out from said retainer inboard of said retainer ends and spaced apart a distance substantially equal to the distance between said spaced ramps whereby, as said unitary assembly is installed, said flexible legs interengage with said spaced ramps with a locking force sufficient to lock said retainer to said block and thereby retain said cover to said block, said locking force being greater than said retention force whereby said retainer ends are pulled from between said cover walls as said cover is removed so that said retainer stays with said insulator block and between said fuse blades, thereby allowing said fuses to remain with said block and be easily removed and replaced prior to reinstalling said cover.

* * * * *